United States Patent [19]

Sestak et al.

[11] Patent Number: 4,941,519

[45] Date of Patent: Jul. 17, 1990

[54] LIQUID FEED SYSTEM USING A NON-REUSABLE CONTAINER

[75] Inventors: Joseph T. Sestak; Robert W. Childers, both of Erie, Pa.

[73] Assignee: American Sterilizer Company, Erie, Pa.

[21] Appl. No.: 233,776

[22] Filed: Aug. 19, 1988

[51] Int. Cl.[5] ..... B65D 49/00; B65B 3/04

[52] U.S. Cl. ..... 141/22; 141/18; 141/264; 137/588; 222/147

[58] Field of Search ..... 422/257, 283; 141/18, 141/20, 21, 22, 29, 95, 250, 263, 264, 266, 269, 275, 276, 278; 222/382, 464, 325–327, 381, 147; 604/403, 414, 110, 416, 415, 905; 137/588, 592, 67, 797; 128/205.21

[56] References Cited

U.S. PATENT DOCUMENTS

| | | | |
|---|---|---|---|
| 1,585,912 | 5/1926 | Heublein | 604/416 X |
| 2,101,471 | 12/1937 | Greenbaum | 222/147 X |
| 2,721,005 | 10/1955 | Lesnick | 222/147 |
| 3,207,190 | 9/1965 | Silbereis et al. | 137/588 |
| 3,322,155 | 5/1967 | Julow | 137/67 |
| 3,386,626 | 6/1968 | Kearney | 222/147 |
| 4,144,915 | 3/1979 | Henderson | 141/18 |
| 4,161,197 | 7/1979 | Stevenson | 141/18 |
| 4,227,818 | 10/1980 | Gacki et al. | 141/94 |
| 4,285,445 | 8/1981 | Vander Molen et al. | 222/464 |
| 4,294,276 | 10/1981 | Harrison | 137/67 |
| 4,635,824 | 1/1987 | Gaunt et al. | 141/94 |
| 4,722,463 | 2/1988 | Anderson | 137/588 |

*Primary Examiner*—Henry J. Recla
*Assistant Examiner*—Casey Jacyna
*Attorney, Agent, or Firm*—Kirkpatrick & Lockhart

[57] ABSTRACT

Apparatus for dispensing a liquid into equipment having an inlet port includes a container for holding the liquid, a tube in the container through which the liquid can exit the container, a connection member for fluidly connecting the tube to the inlet port of the equipment and for venting the container, and a cam member for moving the connection member into a first position for sealingly engaging the connection member to the container and the tube for transferring liquid from the container to the inlet port, into a second position wherein the tube is rendered ineffective for permitting fluid to pass out of the container, and into a third position wherein the container can be removed and replaced with another container having an effective tube and a fresh supply of liquid.

15 Claims, 4 Drawing Sheets

LIQUID FEED SYSTEM USING A NON-REUSABLE CONTAINER

BACKGROUND OF THE INVENTION

Field of the Invention

The present invention relates to apparatus for dispensing liquid and, more particularly to such an apparatus which employs a non-reusable container.

In certain types of precision equipment, the liquid dispensed into the equipment must be of high quality or in precise quantities. Liquid feed systems which permit the liquid containers to be refilled by the user are susceptible of becoming contaminated or of having imprecise quantities of the liquid added to the container. In some instances, it is possible to put the wrong grade or concentration of the liquid into the container. For example, in some hydrogen peroxide sterilization systems, it is necessary to use hydrogen peroxide within a limited concentration range. A more concentrated solution of hydrogen peroxide can be hazardous and a less concentrated solution might be ineffective to achieve sterilization under the conditions present in the particular sterilization system. A technician, unaware of the importance of using a particular type of hydrogen peroxide or other liquid, might refill a liquid container with the incorrect type of liquid.

In addition, continuous reuse of containers tends to contaminate the container. Hydrogen peroxide solutions will degrade into water and oxygen in the presence of certain contaminants resulting in a less concentrated solution which may be ineffective for its intended use. Moreover, if the container is sealed, the buildup of oxygen will pressurize the container, eventually causing it to burst.

There is a need, therefore, for a liquid feed system which ensures that the correct quantity and quality of liquid will be used. There is a further need for a liquid feed system which employs a non-reusable container.

SUMMARY OF THE INVENTION

The present invention provides an apparatus for dispensing a liquid into equipment having an inlet port. The apparatus includes a container for holding the liquid, means in the container for permitting the liquid to exit the container, means for fluidly connecting the container to the inlet port of the equipment and for venting the container, and means for moving the connecting means into a first position wherein the connecting means sealingly engages the container for transferring the liquid through the exit permitting means to the inlet port, and for moving the connecting means into a second position wherein the exit permitting means is rendered ineffective for passing the liquid from the container.

The moving means, preferably a cam member, may also be structured to move the connecting means into a third position wherein the container can be removed and replaced with another container having an effective exit permitting means. The cam member preferably has a first surface for moving the connecting means into the first position upon contact with the connecting means, a second surface for moving the connecting means into the second position upon contact with the connecting means, and a third surface for moving the connecting means into the third position. Means are provided for assuring that the cam member moves only from the first to the second position, from the second to the third position and from the third position to the first position.

The connecting means preferably includes a first conduit for fluidly connecting the exit permitting means to the inlet port, a second conduit for venting the container, sealing means for sealingly engaging the container when the moving means is in at least the first position and means, such as a spring, for maintaining contact between the connecting means and the moving means.

BRIEF DESCRIPTION OF THE DRAWINGS

The present invention can be understood better by reference to the drawings in which.

DETAILED DESCRIPTION OF THE PREFERRED EMBODIMENT

Figure 2:
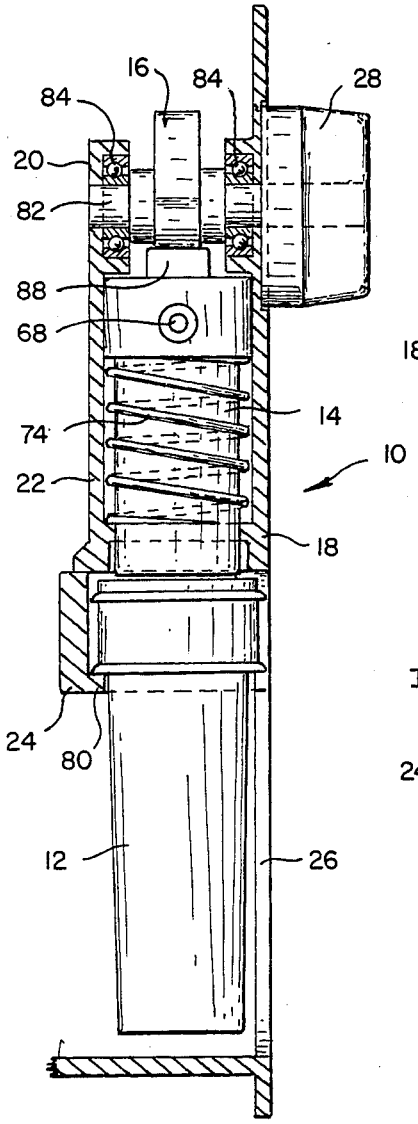
FIG. 2 is a side elevation view of the apparatus of the present invention taken through the lines II—II of FIG. 1.
Figure 1:
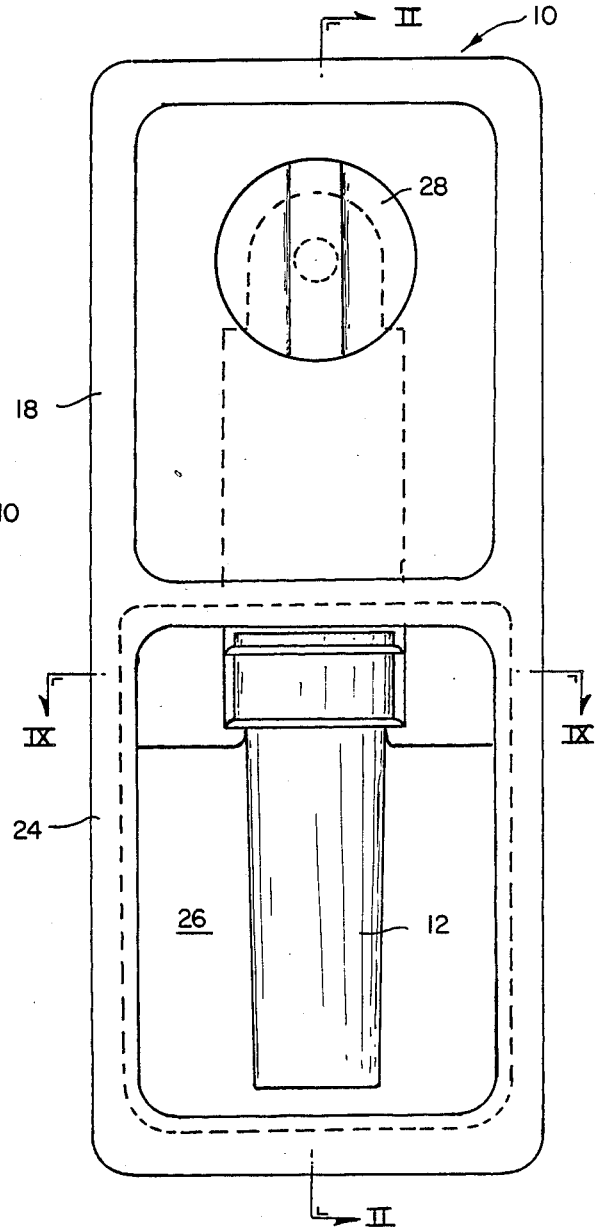
FIG. 1 is a front view of the preferred embodiment of the apparatus of the present invention.

FIGS. 1 to 10 illustrate the preferred embodiments of the liquid feed system of the present invention. Referring to FIGS. 1 and 2, the apparatus 10 generally includes a non-reusable container 12, a connection member 14 and a cam member 16. A housing 18 includes a top portion 20 in which the cam member 16 is positioned, a mid portion 22 in which the connection member 14 is positioned and a bottom portion 24 having an opening 26 for receiving the non-reusable container 12. A knob 28 is positioned on the exterior of housing 18 to effect movement of cam member 16. Some indicia may be placed on the face of knob 28 to provide an indication to the user of the position of cam member 16 and connection member 14.

Figure 3:
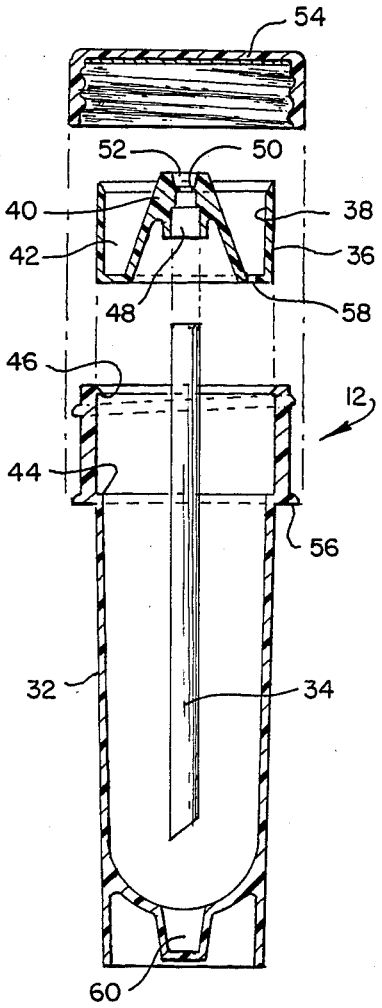
FIG. 3 is an exploded sectional view of the container of the apparatus shown in FIG. 1.

As shown in FIG. 3, the container 12 includes a bottom portion 32 for holding the liquid, a dip tube 34 for permitting the liquid to exit the container, and an insert 36 having side walls 38 and a nipple 40 which define therebetween a recess 42. The bottom of insert 36 rests on flange 44 in the inside of bottom portion 32. A lip 46 holds the top of insert 36 in place. The insert 36 may be either tightly mechanically sealed at flange 44 or heat sealed at its perimeter to bottom portion 32. The nipple 40 has an opening 52 with a narrow portion defined between a flexible rim 50. Dip tube 34 extends from a counterbored section 48 in the opening 52 of nipple 40 to just above a recess 60 in the bottom of bottom portion 32. The bottom of dip tube 34 preferably is cut at an angle to permit liquid to enter dip tube 34 from the bottom for transfer out of container 12. Dip tube 34 is preferably made of a high density polyethylene and has a small internal diameter so that, if inverted during transit, the fluid is held in place within dip tube 34 by capillary action and will not leak into recess 42. The small volume of liquid in the dip tube 34 is all that will spill out if the container 12 is inverted during shipping and handling. Thus, exposure to potentially hazardous liquids in the container 12 is greatly minimized. A threaded cap 54 is provided to securely cover container 12 prior to use during transit and storage. Cap 54 preferably has a hydrophobic vent of any suitable known variety which will prevent liquid from spilling out while preventing a buildup of pressure in container 12.

Cam member 16 has a bore 86 therethrough for receiving rod 82 for connection to knob 28. Ball bearings 84 are provided in the preferred construction to permit rod 82 to turn within housing 18 with relative ease when knob 28 is turned. Cam member 16 preferably has three different regions or surfaces which, when brought into contact with connection member 14 by turning knob 28, move connection member 14 into one of three positions, as will be described in more detail hereinbelow.

Figure 4:
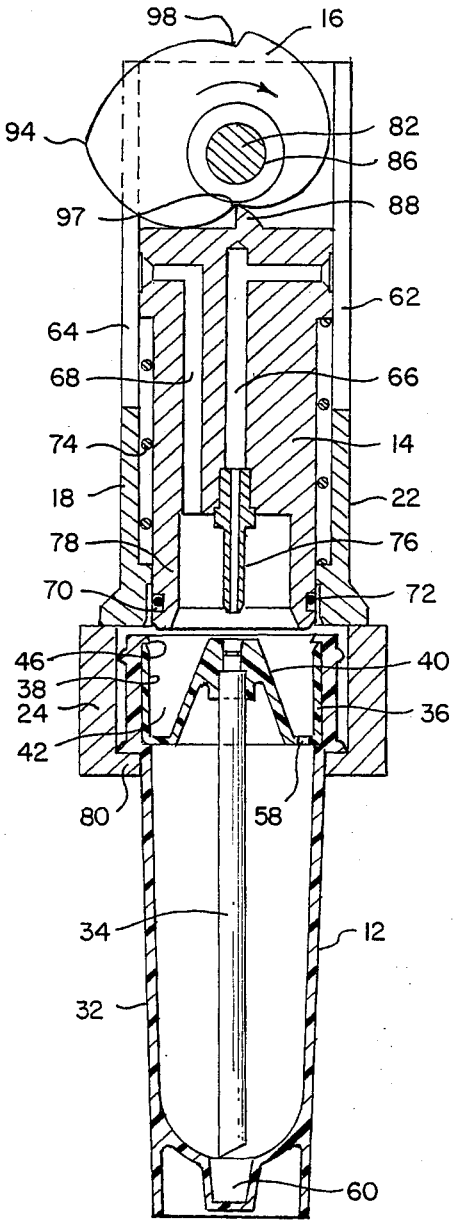
FIG. 4 is a sectional view of the apparatus of FIG. 1 showing the connecting means in the third position.
Figure 5:
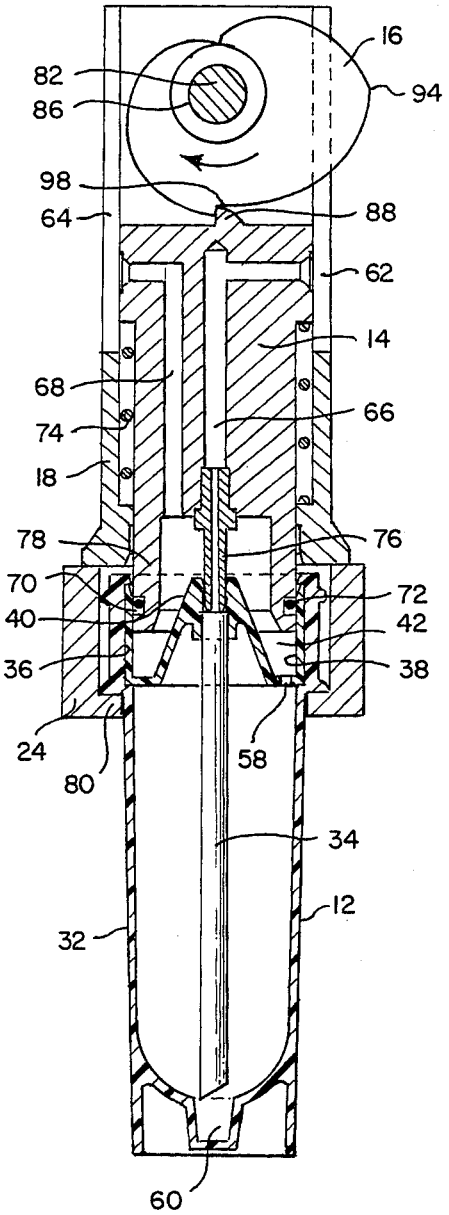
FIG. 5 is a sectional view of the apparatus of FIG. 1 showing the connecting means in the first position.
Figure 6:
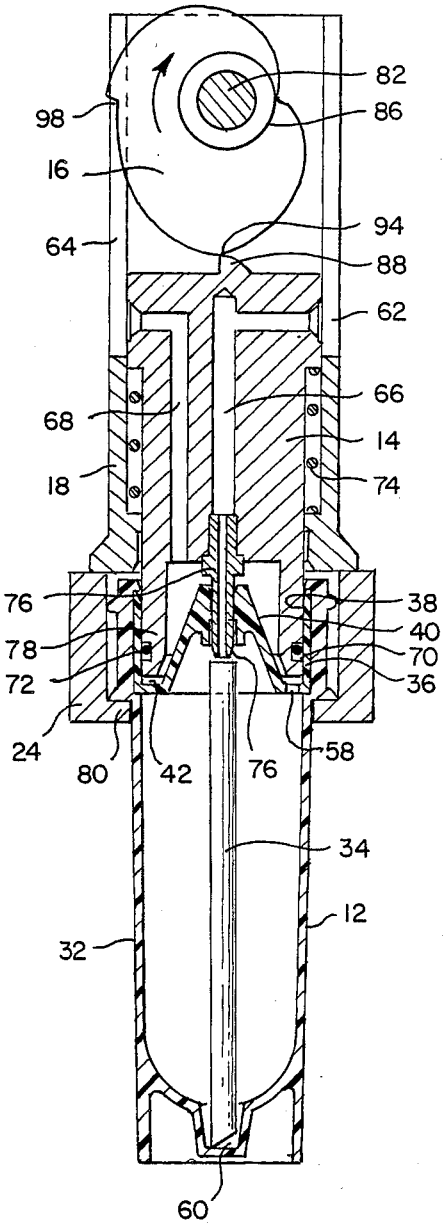
FIG. 6 is a sectional view of the apparatus of FIG. 1 showing the connecting means in the second position.
Figure 7:
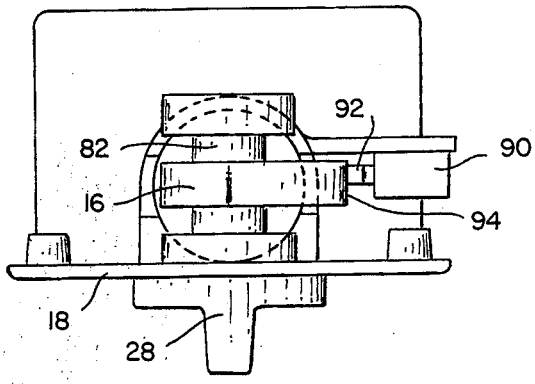
FIG. 7 is a top view of the apparatus of FIG. 1.
Figure 8:
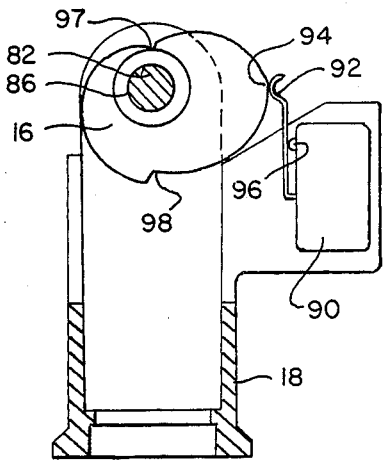
FIG. 8 is a sectional view of the cam member and sensor of the apparatus of FIG. 1.

Connection member 14, as shown in FIGS. 4–6, includes a first conduit 66 for connection through a slit 62 in housing 18 to the inlet port (not shown) of the equipment (also not shown), and a second conduit 68 for venting through a slit 64 in housing 18.

The inlet port of the equipment is preferably a vacuum port. A vacuum connection can be used to draw liquid from container 12. The vent port provides air to equalize the vent in container 12 during withdrawal of the liquid or to positively pressurize container 12 to force liquid out through dip tube 34.

Vacuum and pressure are not required to move fluid. Any other suitable method for withdrawing liquid from container 12 which creates a pressure differential in conduits 66 and 68 to dispense fluid into the equipment may be used.

Connection member 14 preferably has a lead-in chamfer that aligns container 12 so that a needle 76 will be concentric with opening 52. It may also include a groove 70 for receiving an O-ring 72. O-ring 72 provides a seal which is necessary if the vent port is positively pressurized or if liquid is returned to container 12. The needle 76 extends from the first conduit 66 for insertion into the opening 52 in nipple 40 of container 12. A spring 74 or other suitable biasing means rests in a recess defined between the interior of housing 18 and the exterior of connection member 14.

Spring 74 urges connection member 14 toward cam member 16 to maintain the contact between the two structures and to prevent connection member 14 from sliding too far into recess 42.

FIG. 4 illustrates an intact container 12 inserted into the bottom portion 24 of housing 18. A flange 56 on the exterior of container 12 rests on rim 80 of bottom portion 24. Cam member 16 is in a position wherein its surface 97 which is the minimal distance from bore 86 is brought into contact with a cam follower/stop 88 on the top of connection member 14. Connection member 14 is entirely within mid portion 22 of housing 18. There is no fluid connection between connection member 14 and container 12.

FIG. 5 illustrates cam member 16 moved to a position wherein its surface 98 is brought into contact with cam follower/stop 88 to force connection member 14 downward into fluid connection with container 12. Knob 28 is moved 180° clockwise to effect the fluid connection. The bottom of connection member 14 moves into the bottom portion 24 of housing 18. Needle 76 is inserted into opening 52 in nipple 40 to meet the top of dip tube 34. The bottom section 78 of connection member 14 enters recess 42 in insert 36 and O-ring 72 abuts sidewalls 38 to provide a seal between connection member 14 and container 12. Needle 76 is wider than the opening between flexible rim 50 of opening 52. When needle 76 is forced between rims 50, a second seal is formed between the connection member 14 and container 12.

In the position shown in FIG. 5, fluid can be transferred from container 12 through dip tube 34, needle 76 and first conduit 66 to the inlet or vacuum port of the equipment. The equipment may be adapted to withdraw the entire liquid contents of container 12 or to withdraw only measured amounts of liquid at desired or predetermined intervals. One or more vents 58 (preferably three) in the bottom of insert 36 permit air or some other gas to enter the bottom 32 of container 12 to displace the withdrawn liquid. Vents 58 may optionally be covered with a hydrophobic material to permit the flow of gases therethrough but to prevent the flow of liquid. Liquid can thus be prevented from leaking into recess 42 if container 12 is inverted during shipping and handling. The air or gas is directed to container 12 through conduit 68 in connection member 14 and may come from any suitable source, such as a pressure port in the equipment.

After all of the fluid has been withdrawn from container 12, knob 28 is rotated 90° clockwise to move cam member 16 into a position wherein its surface 94 which is the greatest distance from bore 86 is brought into contact with cam follower/stop 88 to force connection member 14 further into bottom portion 24 of housing 18 and into recess 42 of insert 36 to render dip tube 34 ineffective. FIG. 6 illustrates needle 76 forced through the counterbored section 48 of opening 52 in nipple 40 to disconnect dip tube 34 from the opening 52. With dip tube 34 disconnected in this manner, fluid cannot be withdrawn from container 12 by the liquid feed system for use in the equipment. Container 12 cannot be reused. Any liquid remaining in container 12 can now be readily emptied by inverting the container because dip tube 34 no longer blocks opening 52. A new container 12 having a fresh supply of the desired fluid and an effectively engaged dip tube 34 can be inserted into the apparatus 10.

To remove the spent container 12 and insert a new container 12, knob 28 is turned another 90° clockwise to return cam member 16 to the position shown in FIG. 4. Spring 74 urges connection member 14 back up into the mid portion 22 of housing 18 out of recess 42 of insert 36. Needle 76 is withdrawn from opening 56 of nipple 40. The spent container 12 can then be removed and a new container 12 can be inserted as previously described.

Cam follower/stop 88 and the detents on cam member 16 prevent cam member 16 from turning counterclockwise to prevent moving connection member 14 from the position in which the fluid connection between container 12 and conduits 66 and 68 is made directly to the position in which a new container 12 can be added without first moving connection member 14 to the position in which dip tube 34 is rendered ineffective.

Figure 9:
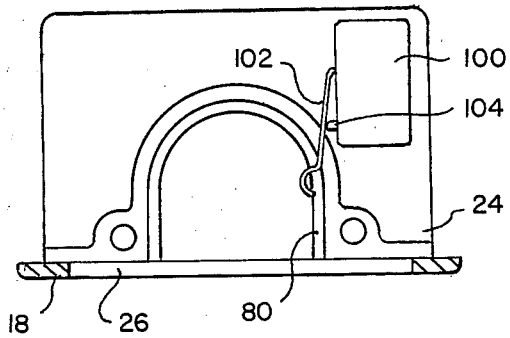
FIG. 9 is a sectional view taken through the line IX—IX of FIG. 1 showing a sensor and a portion of the container.

A sensor 90 may optionally be provided near cam member 16 to indicate that container 12 is fluidly connected through connection member 14 to the inlet port of the equipment. Referring to FIG. 9, when cam member 16 is in the position shown in FIG. 5, surface 98 of cam member 16 is in contact with cam follower/stop 88 of connection member 14 thereby moving conduits 66 and 68 of connection member 14 into fluid contact with container 12. Surface 94 of cam member 16 is in contact with arm 92 of sensor 90, thereby forcing lever 92 against the microswitch 96 of sensor 90. A signal is transmitted in any suitable form, preferably to a computer, to indicate that container 12 is in fluid connection with the inlet port of the equipment. Arm 92 of sensor 90 does not normally touch contact 96. Only when the surface 94 of cam member 16 which is the greatest distance from bore 86 of any surface of cam member 16 is arm 92 forced against contact 96.

Another sensor 100 as shown in FIG. 9, may optionally be provided to indicate when a container 12 is in place. The sensor 100 has a lever 102 which is not normally in contact with microswitch 104. When a container 12 is in place within the bottom portion 24 of housing 18, lever 102 is forced against microswitch 104 which then transmits a signal to indicate that a container 12 is in place. The equipment can have suitable controls to prevent operation of the equipment unless the sensors 90 and 100 indicate that fluid connection has been made and a container 12 is in place. Sensors 90 and 100 may be any suitable known sensors, such as the standard lever activated microswitch shown.

Additional sensors can be provided to indicate whether fluid is in the container 12 and/or whether the fluid is being transferred to the equipment.

Figure 10:
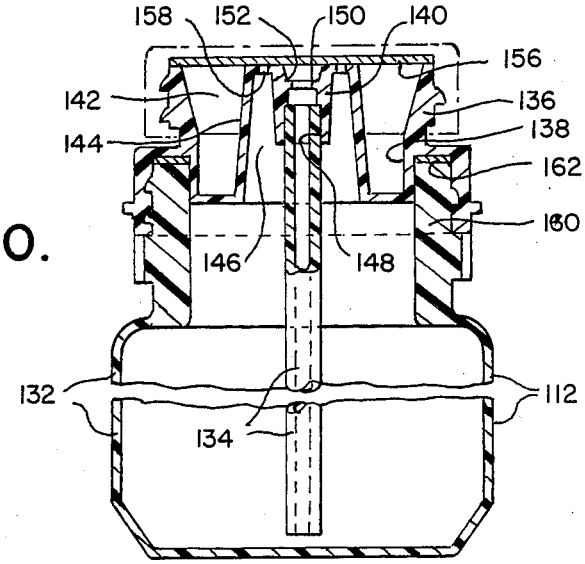
FIG. 10 is a sectional view of an alternative embodiment of the apparatus of the present invention.

An alternative embodiment of the container is shown in FIG. 10. container 112 includes a bottom portion 132 for holding the liquid, a dip tube 134 for permitting the liquid to exit the container, and an insert 136 having sidewalls 138, interior walls 144 and a nipple 140. A recess 142 is defined between walls 138 and 144. A recess 146 is defined between walls 144 and nipple 140. Vents 158 in recess 146 open to the exterior of contianer 112 when cap liner 156 is removed. Cap liner 156 prevents leaks of fluid during transport of the containers 112.

Nipple 140 has an opening 152 with a narrow portion defined between a fexible rim 150. Dip tube 134 extends from a counterbored section 148 in the opening 152 of nipple 140 to just to the bottom of bottom portion 132. Dip tube 134 is similar to dip tube 34. Bottom portion 132 is wider than bottom portion 32 and may be any suitable length.

Insert 136 is threaded to a top portion 160 of container 112. A seal 162 is provided between top portion 160 and insert 136.

Container 112 functions in the same manner as container 12. The placement of vents 158 and the addition of cup liner 156 in the insert 136 however are designed to decrease the opportunity for spills during transport of full containers 112.

The apparatus 10 of the present invention provides a unique liquid feed system for use with a variety of different types of equipment. The liquid feed system employs a non-reusable container to assure that only the correct fluid of the desired quality and quantity is used in the equipment. The containers 12 and 112 are especially suited for holding liquids that require some ventilation during shipping and storage. The design of both containers 12 and 112 minimizes potentially hazardous spills.

What is claimed is:

1. Apparatus for dispensing a liquid into equipment having an inlet port comprising:

a container for holding the liquid having a top portion with an opening and a bottom portion for holding said liquid said container having means removably positioned in said opening and extending from said opening into said bottom portion for permitting the liquid to exit said container;

means for fluidly connecting said exit permitting means of said container to the inlet port of the equipment and for venting said container; and means for moving said connecting means into a first position wherein said connecting means sealingly engages said container for transferring the liquid through said exit permitting means to the inlet port, and for moving said connecting means into a second position wherein said exit permitting means is rendered permanently ineffective for passing liquid from said container such that said exit permitting means cannot thereafter be fluidly connected to the inlet port of the equipment.

2. The apparatus recited in claim 1 wherein said moving means is structured to move said connecting means into a third position wherein said container can be removed and replaced with another said container having an effective said exit permitting means.

3. The apparatus recited in claim 2 further comprising means to indicate when said container is in the apparatus.

4. The apparatus recited in claim 1 wherein said exit permitting means is a tube.

5. The apparatus recited in claim 1 wherein said connecting means comprises:

a first conduit for fluidly connecting said exit permitting means to the inlet port of the equipment;

a second conduit for venting said container;

sealing means for sealingly engaging said container when said moving means is in at least said first position; and means for maintaining contact between said connecting means and said moving means.

6. The apparatus recited in claim 5 wherein said container has a first opening for receiving said first conduit in a sealed engagement and for fluidly connecting said first conduit to said exit permitting means, and a second opening for venting said container.

7. The apparatus recited in claim 1 wherein said moving means comprises a cam member having a first surface for moving said connecting means into said first position upon contact with said connecting means and a second surface for moving said connecting means into said second position upon contact with said connecting means.

8. The apparatus recited in claim 7 wherein said cam member is structured to move said connecting means into a third position wherein said container can be removed and replaced with another said container and said cam member has a third surface for moving said connecting means into said third position upon contact with said connecting means.

9. The apparatus recited in claim 8 further comprising means for assuring that said cam member moves only from said first position to said second position, from said second position to said third position and from said third position to said first position.

10. The apparatus recited in claim 1 wherein said apparatus is releasably connected to the equipment.

11. The apparatus recited in claim 1 wherein said apparatus is integrally connected to the equipment.

12. The apparatus recited in claim 1 further comprising means to indicate when said connecting means is in said first position.

13. A container for use with an apparatus for dispensing a liquid into equipment having an inlet port, said container comprising:

a top portion having an opening therethrough for receiving a member for fluidly connecting the container to the inlet port of the equipment; and a bottom portion for holding the liquid;

means extending from said opening into said bottom portion for permitting the liquid to exit said bottom portion when said member is received within said opening, said exit permitting means being removably positioned in said opening to permit said exit permitting means to be disconnected from said opening to render said exit permitting means permanently ineffective for passing liquid from said bottom portion.

14. The container recited in claim 13 wherein said exit permitting means is a tube.

15. The container recited in claim 13 wherein said top portion has a second opening for venting said bottom portion.

* * * * *

UNITED STATES PATENT AND TRADEMARK OFFICE

CERTIFICATE OF CORRECTION

PATENT NO. : 4,941,519

DATED : July 17, 1990

INVENTOR(S) : Joseph T. Sestak and Robert W. Childers

It is certified that error appears in the above-identified patent and that said Letters Patent is hereby corrected as shown below:

Col. 5, line 33, delete "container" and substitute therefor --Container--.

Col. 5, line 39, delete "contianer" and substitute therefor --container--.

Col. 6, line 5, after "liquid", insert --,--.

Signed and Sealed this

Fifth Day of May, 1992

*Attest:*

DOUGLAS B. COMER

*Attesting Officer*

*Acting Commissioner of Patents and Trademarks*